US008770345B2

(12) United States Patent
Dugan et al.

(10) Patent No.: US 8,770,345 B2
(45) Date of Patent: Jul. 8, 2014

(54) GYPSUM-PANEL ACOUSTICAL MONOLITHIC CEILING

(75) Inventors: Erin Dugan, Grayslake, IL (US); Mark Miklosz, Western Springs, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/534,454

(22) Filed: Jun. 27, 2012

(65) Prior Publication Data

US 2014/0000978 A1 Jan. 2, 2014

(51) Int. Cl.
*E04B 1/84* (2006.01)

(52) U.S. Cl.
USPC ..... 181/291; 52/144

(58) Field of Classification Search
USPC ..... 181/290, 291, 293; 52/144, 145
See application file for complete search history.

(56) References Cited

U.S. PATENT DOCUMENTS

| | | | | |
|---|---|---|---|---|
| 2,045,311 | A | 6/1936 | Roos et al. | |
| 2,126,956 | A | 8/1938 | Gilbert | |
| 2,307,978 | A | 1/1943 | Williams | |
| 2,814,080 | A * | 11/1957 | Tvorik et al. | 52/417 |
| 4,040,213 | A | 8/1977 | Capaul | |
| 4,135,341 | A | 1/1979 | Johnson et al. | |
| 4,222,803 | A | 9/1980 | Kent et al. | |
| 4,347,912 | A | 9/1982 | Flocke et al. | |
| 4,428,454 | A | 1/1984 | Capaul et al. | |
| 5,178,939 | A | 1/1993 | Caldwell | |
| 5,558,710 | A | 9/1996 | Baig | |
| 5,674,594 | A * | 10/1997 | Sensenig | 428/206 |
| 6,284,351 | B1 | 9/2001 | Sensenig | |
| 6,675,551 | B1 * | 1/2004 | Fuchs | 52/791.1 |
| 7,503,430 | B2 | 3/2009 | Englert et al. | |
| 7,661,511 | B2 | 2/2010 | Hasagawa et al. | |
| 7,703,243 | B2 | 4/2010 | Baig | |
| 7,836,652 | B2 * | 11/2010 | Futterman | 52/417 |
| 7,851,057 | B2 | 12/2010 | Englert et al. | |
| 7,906,205 | B2 | 3/2011 | Meres | |

(Continued)

FOREIGN PATENT DOCUMENTS

| | | |
|---|---|---|
| DE | 3147174 A1 | 6/1983 |
| EP | 2591181 | 1/2012 |

(Continued)

OTHER PUBLICATIONS

Notification of Transmittal of the International Search Report and the Written Opinion of the International Searching Authority, or the Declaration of PCT/US2013/047280, filed Jun. 24, 2013, International Search Report dated Oct. 9, 2013, Written Opinion of the International Searching Authority.

*Primary Examiner* — Jeremy Luks
(74) *Attorney, Agent, or Firm* — Pearne & Gordon LLP

(57) ABSTRACT

An acoustical panel for forming a monolithic ceiling or wall, the panel extending across a rectangular area, and having a core made primarily of gypsum, the core being essentially coextensive with the panel area such that it has two opposed sides, each of an area substantially equal to the area of the panel, the core having a multitude of perforations extending generally between its sides, the perforations being distributed substantially uniformly across the full area of the core and being open at both sides of the core, the face side of the core being covered by a porous layer, the perforations being optionally restricted at a rear side of the core, the porous layer at the face side of the core being suitable for adherence of drywall joint compound and a water-based non-blocking paint.

13 Claims, 2 Drawing Sheets

(56) References Cited

U.S. PATENT DOCUMENTS

| | | | | |
|---|---|---|---|---|
| 8,100,226 | B2 | 1/2012 | Cao et al. | |
| 2005/0193668 | A1* | 9/2005 | Hamilton | 52/371 |
| 2005/0211500 | A1* | 9/2005 | Wendt et al. | 181/295 |
| 2007/0051062 | A1 | 3/2007 | Baig et al. | |
| 2007/0102237 | A1 | 5/2007 | Baig | |
| 2007/0186493 | A1* | 8/2007 | Baig | 52/144 |
| 2008/0245026 | A1* | 10/2008 | Hamilton | 52/698 |
| 2009/0094922 | A1* | 4/2009 | Newton et al. | 52/417 |
| 2010/0300025 | A1 | 12/2010 | Houck et al. | |
| 2011/0076470 | A1 | 3/2011 | Zaveri | |
| 2012/0240486 | A1 | 9/2012 | Borroni | |
| 2013/0133978 | A1 | 5/2013 | Borroni | |

FOREIGN PATENT DOCUMENTS

| | | | |
|---|---|---|---|
| GB | 2203772 | A | 10/1988 |
| JP | 58-218538 | A | 12/1983 |
| WO | 2010/105655 | A1 | 9/2010 |

* cited by examiner

GYPSUM-PANEL ACOUSTICAL MONOLITHIC CEILING

BACKGROUND OF THE INVENTION

The invention relates to building materials and systems and, in particular, to an acoustical panel for constructing monolithic ceilings and interior walls.

PRIOR ART

Sound absorption in buildings is commonly achieved with ceiling tiles carried on a suspended grid. Generally, the sound absorbing capacity of the tiles is achieved by material selection and/or characteristics of the room facing surface. Ceiling tile installations have the advantage of affording ready access to the space above the ceiling, but the divisions between the tiles, even when the grid is concealed, remain visible. Architects and interior designers have long sought a monolithic, texture free look in an acoustical ceiling particularly when there is no expected need for access to the space above the ceiling. Ordinary gypsum panel drywall ceiling construction does not achieve a sufficiently high noise reduction coefficient (NRC) that would qualify as acoustical. Perforated gypsum panels may achieve an acceptable NRC level but they are not monolithic in appearance.

SUMMARY OF THE INVENTION

The invention resides in the discovery that ordinary gypsum panels, such as drywall sheets, can be modified to construct an acoustical ceiling or wall with a monolithic plain face and surprising acoustical properties. Such panels can achieve an NRC of 0.70 or more.

In accordance with the invention, the gypsum core is made with a multitude of perforations or holes distributed throughout its planar area. The perforations or holes are restricted, preferably with a painted non-woven porous scrim fabric or veil at the front face and, optionally, a non-woven porous acoustical fabric at the back side.

The gypsum panel can be made, for example, by perforating standard sheets of drywall and thereafter covering the perforated sides of the sheet with additional laminated sheets or layers. These perforating and laminating steps can be performed by the original manufacturer of the drywall sheets or by a separate entity independent of the original drywall manufacturer.

Variations in the construction of the gypsum panel are contemplated. Common among these variations is a panel with a perforated gypsum core and with a face covered by a structure that is porous while appearing essentially imperforate to the unaided eye.

The disclosed gypsum-based panels can be installed in the same manner or a like manner as ordinary drywall. For ceiling applications, the acoustical panels of the invention can be screwed to a conventional drywall suspension system of grid tees or "hat channels" carried on black iron channels typically used in commercial applications or they can be attached to wood framing more often used in residential construction. Acoustical walls can be built by attaching the inventive acoustical panels to vertical studs, serving as spaced support elements. It will be seen that the inventive panels can be readily taped and painted like ordinary drywall, using the same or similar materials, equipment, tools and skills, to produce a smooth monolithic ceiling or wall.

DESCRIPTION OF THE PREFERRED EMBODIMENT

Figure 1:
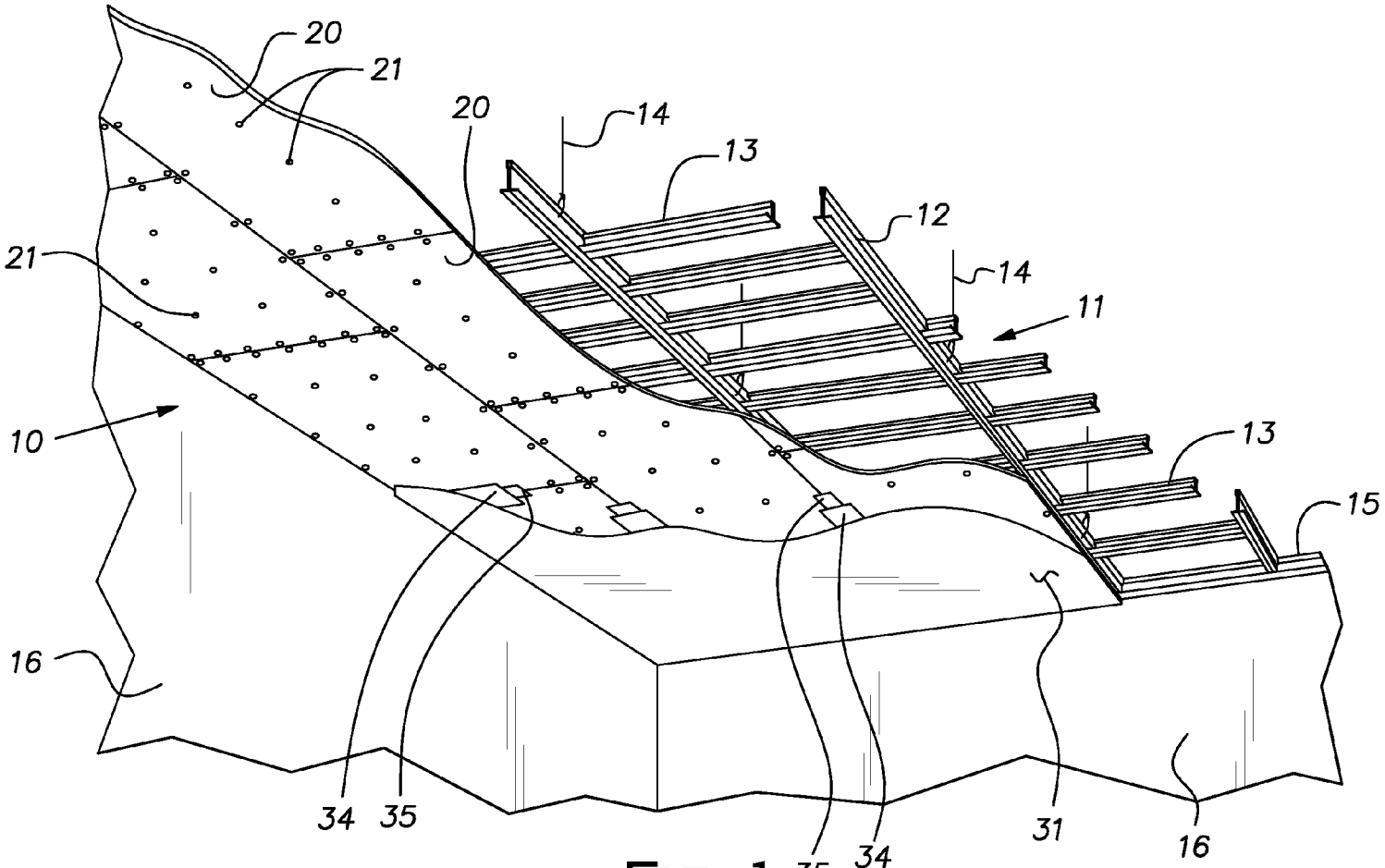
FIG. 1 is a fragmentary, schematic, isometric view of a monolithic acoustical ceiling.

Referring now to FIG. 1, there is shown a schematic partial view of an acoustical monolithic ceiling installation 10. Portions of layers of the ceiling 10 are peeled away to reveal constructional details. The ceiling 10 is a suspended system including a drywall grid 11, known in the art, comprising main tees 12 spaced on 4 ft. centers and intersecting cross tees 13 spaced on 16 in. or 2 ft. centers. Dimensions used herein are typically nominal dimensions and are intended to include industry recognized metric equivalents. The main tees 12, to which the cross tees 13 are interlocked, are suspended by wires 14 attached to a superstructure (not shown). A perimeter of the grid 11 is conventionally formed by channel molding 15 secured to respective walls 16.

Acoustical panels 20 are attached to the lower sides of the grid tees 12, 13 with self-drilling screws 21. The illustrated acoustical panels are 4 ft. by 8 ft. in their planar dimensions, but can be longer, shorter and/or of different width as desired or practical. The size of the panel 20 and spacing of the grid tees 12 and 13, allows the edges of the panel to underlie and be directly attached to a grid tee, assuring that these edges are well supported.

Figure 2:
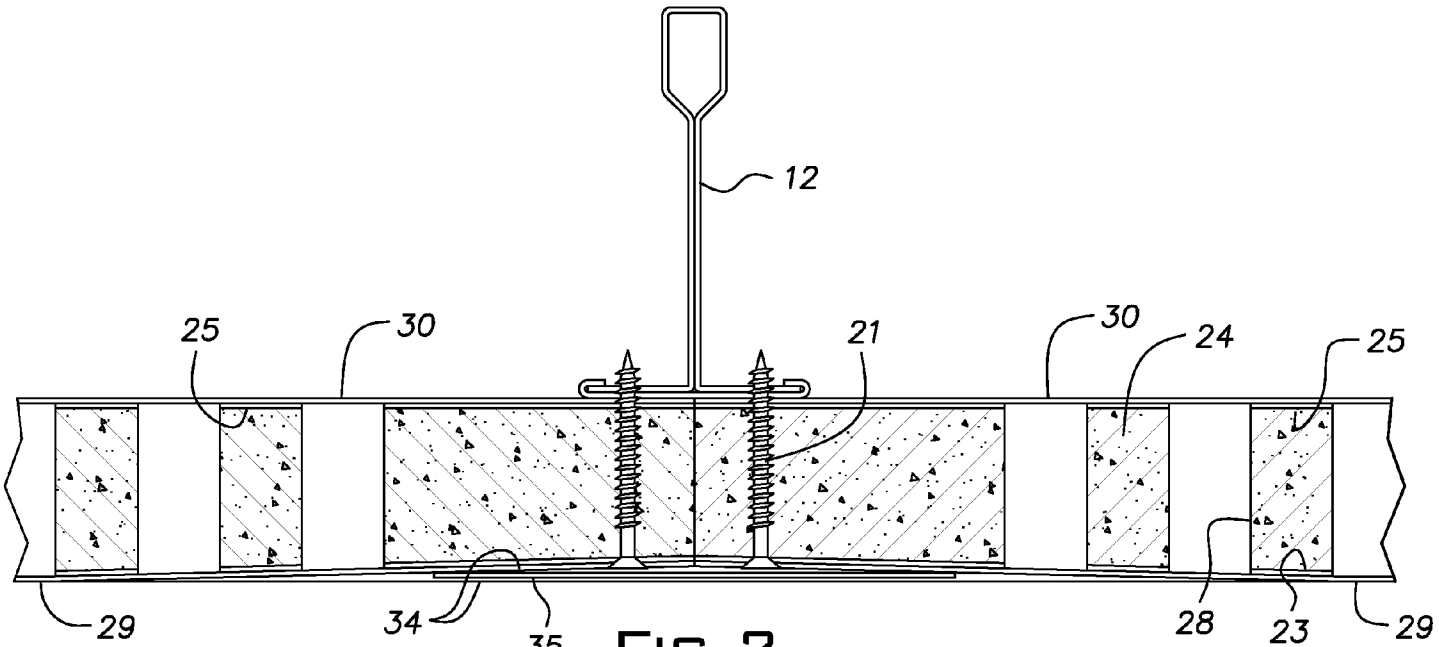
FIG. 2 is a fragmentary, cross-sectional view, on an enlarged scale, of the monolithic ceiling.

Referring to FIG. 2, the acoustical panel 20 of the invention is characterized with a perforated gypsum core 24. One method of providing the core 24 is to modify a standard commercially available sheet of drywall by perforating it through a front paper face 23, the gypsum core 24, and a rear paper side or face 25. Perforations 28 can be formed by drilling, punching, or with other known hole-making techniques. The perforations 28 are preferably uniformly spaced; by way of an example, the perforations can be round holes of 8 mm diameter on 16 mm centers. This arrangement produces a total area of the perforations substantially equal to 20% of the full planar area of a panel 20. Other hole sizes, shapes, patterns and densities can be used. For example, tests have shown that a hole density of 9% of the total area can achieve good results. Marginal areas, as well as intermediate areas corresponding to centers of support grid, joists, or studs, of a sheet can be left unperforated to maintain strength at fastening points.

Sheets 29, 30 are laminated to both full sides of the perforated drywall sheet thereby at least partially closing both ends of the perforations 28. At a rear side of the drywall, the backer sheet or web 30 is preferably an acoustically absorbent non-woven fabric known in the acoustical ceiling panel art. By way of example, the backer fabric can be that marketed under the trademark SOUNDTEX® by Freudenberg Vliesstoffe KG. It has a nominal thickness of 0.2 to 0.3 mm and a nominal weight of 63 g/m$^2$. Specifically, the main components of this non-woven fabric example are cellulose and E-glass with a synthetic resin binder such as polyacrylate, poly(ethylene-CO-vinylacetate). Alternatively, for example, the backer sheet 30 can be a porous paper layer. The sheet 30 can be provided with a suitable adhesive for binding it to the rear paper side 25 of the modified drywall sheet 22.

At a front side of the drywall sheet 22, a sheet or web in the form of a non-woven fabric scrim layer 29 is attached with a suitable adhesive. The facing layer or sheet 29 is porous; a suitable material for this application is that used commercially as a cover or face for conventional acoustical ceiling panels. An example of this type of veil material is that marketed by Owens Corning Veil Netherlands B.V. under the product code A125 EX-CH02. This scrim fabric comprises hydrated alumina fiberglass filament, polyvinyl alcohol, and acrylate copolymer. The unpainted scrim 29 has a nominal weight of 125 g/m$^2$ and an air porosity, at 100 Pa, of 1900 l/m$^2$ sec. To avoid blocking the face scrim 29, the adhesive can be initially applied to the panel or sheet 22. The facing sheet 29 should be sufficiently robust to withstand field finishing operations described below. It should also be compatible with drywall joint compound or similar material and commercially available paints, typically water-based paints such as that described below.

The panel 20 with other identical panels is hung on the grid 11 in the same manner as ordinary drywall is installed. Similarly, as shown in FIG. 1, joints 33 are taped in the same way as regular drywall is taped. Drywall joint compound or similar material 34 is used to adhere a tape or similar material 35 to adjacent margins of two abutting panels 20 by applying it directly to the sheets 29 and over the tape 35 to conceal the tape. Typically, the long edges of the panels 20 are tapered to receive the joint tape 35 below the plane of the major part of the panel faces. The joint compound 34 can be conventional drywall joint compound and the tape 35 can be conventional drywall paper or mesh tape. The screws 21 securing the panels 20 to the spaced support elements 12, 13 forming the grid 11 are countersunk, as is conventional in drywall construction, and are concealed with joint compound 34 applied with a taping knife or trowel in the same manner as if applied to ordinary drywall. The panels 20 can be adhesively attached to vertical stud supports when constructing a wall. When dry, the joint compound 34 can be sanded or wet sponged to blend it into the plane of the surface of the face sheet 29.

After the joint compound 34 has been sanded or sponged smooth, the front sheets 29 and remaining joint compound are painted with a commercially available acoustical paint 31 used for painting acoustical tile. An example of a suitable water-based paint, sometimes referred to as a non-blocking paint, is available from ProCoat Products, Inc. of Holbrook, Me. USA, sold under the trademark ProCoustic. To improve the uniformity of the finished appearance of the ceiling, the taped joints can be covered with strips of the veil fabric 29, wide enough to cover the joint compound, prior to painting. The paint application should leave as much porosity through the layer 29 as is desired but leave the appearance of an essentially imperforate surface to the unaided eye so that the perforations 28 are not seen. Alternatively, where high NRC is not necessary, satisfactory results can be obtained by using a conventional primer and a coat of interior latex paint 31 to complete the installation of the ceiling 10. When the term monolithic is used herein, it is to denote that essentially the entire visible surface of a ceiling or wall appears to be a seamless expanse without joints.

A ½ or ⅝ in. drywall-based panel 20, having the described perforation arrangement and front and rear sheets 29, 30 and customary space behind the panel can exhibit NRC values up to and above 0.70, a rating equal to the performance of better-grade acoustical ceiling tile.

Presently, the preferred characteristics of the gypsum-based core 24 are:

Thicknesses: 0.5-0.625 in.

Open area: 9.6-27.7%

Hole diameters: 6-12 mm.

Hole spacing: 15-25 mm.

Following are airflow characteristics of the backer layer 30 of the non-woven SOUNDTEX® material described above and the face layer 29 of the non-woven scrim material described above before and after painting with a proprietary acoustical coating and the acoustical ProCoustic coating.

| | in. thick | U l/min. | P in. $H_2O$ | v mm/s | U m$^3$/s | P Pascal | Airflow Resistance R mks acoustic ohms, (Pa · s/m$^3$) | Specific Airflow Resistance r mks rayls, (Pa · s/m) | Airflow Resistivity $r_o$ mks rayls/m, (Pa · s/m$^2$) | Airflow Resistivity $r_o$ MPa · s/m$^2$) |
|---|---|---|---|---|---|---|---|---|---|---|
| Backer | 0.009 | 2.00 | 0.0156 | 16.4 | 3.33E − 05 | 3.9 | 116,574 | 236 | 1.09E + 06 | 1.09 |
| Unpainted Scrim | 0.019 | 2.00 | 0.0027 | 16.4 | 3.33E − 05 | 0.7 | 20,176 | 41 | 8.47E + 04 | 0.08 |
| Painted Scrim w/ Proprietary Coating | 0.020 | 2.00 | 0.0143 | 16.4 | 3.33E − 05 | 3.6 | 106,859 | 217 | 4.26E + 05 | 0.43 |
| Painted Scrim w/ ProCoustic | 0.020 | 2.00 | 0.0144 | 16.4 | 3.33E − 05 | 3.6 | 107,606 | 218 | 4.29E + 05 | 0.43 |

The tables printed below show NRC values for the inventive board and boards of other constructions for comparison purposes. As in the preceding table, unless otherwise noted, the backer is the SOUNDTEX® material and the face is the scrim identified above.

TEST I:
*Perforated Panel = ⅝ in. FC30 (drywall) with ⅜" diameter perforations, 16 mm o.c. spacing - 27.7% open area

| Panel Configuration | NRC Mounting | 4FA | NRC |
|---|---|---|---|
| A Perforated panel only | E400 | 0.1967 | 0.20 |
| B Panel + backer | E400 | 0.6572 | 0.65 |
| BB Panel + backer used as unpainted face | E400 | 0.6215 | 0.60 |
| H Panel + backer + unpainted scrim face | E400 | 0.7442 | 0.75 |
| I Panel + backer + painted scrim face | E400 | 0.7314 | 0.75 |
| E Panel + backer + paper face | E400 | 0.1978 | 0.20 |
| F Panel + backer + painted paper face | E400 | 0.2963 | 0.30 |
| G Panel + painted scrim face | E400 | 0.5772 | 0.60 |
| K Panel + painted scrim face + unpainted scrim backer | E400 | 0.6376 | 0.65 |
| C Panel + unpainted scrim face | E400 | 0.4028 | 0.40 |

TEST II:
*Perforated Panel = ½ in. Ultralight (drywall) with 6 mm diameter perforations, 15 mm o.c. spacing, ____ borders-hole pattern = 12.6% open area, overall panel = 9.6% open area

| Panel Configuration | NRC Mounting | 4FA | NRC |
|---|---|---|---|
| Perforated panel only | E400 | 0.1937 | 0.20 |
| Panel + backer + unpainted scrim face | E400 | 0.5947 | 0.60 |
| Panel + backer + painted scrim face | E400 | 0.4825 | 0.50 |

TEST III:
Panel A (small holes) = ½ in. Knauf 8/18R with 8 mm. diameter round perforations, 18 mm o.c. spacing & no borders-15.5% open area
Panel B (large holes) = ½ in. Knauf 12/25R with 12 mm. diameter round perforations, 25 mm o.c. spacing & no borders-18.1% open area

| Panel Configuration | NRC Mounting | 4FA | NRC |
|---|---|---|---|
| Panel A only (with backer) | E400 | 0.6480 | 0.65 |
| Panel B only (with backer) | E400 | 0.7191 | 0.70 |
| Panel A + backer + unpainted scrim face | E400 | 0.6245 | 0.65 |
| Panel B + backer + unpainted scrim face | E400 | 0.6810 | 0.70 |
| Panel A + backer + painted scrim face | E400 | 0.5782 | 0.60 |
| Panel B + backer + painted scrim face | E400 | 0.5652 | 0.55 |
| Panel A + backer + painted scrim face over 1 in. fiberglass panel | E400 | 0.6192 | 0.60 |
| Panel B + backer + painted scrim face over 1 in. fiberglass panel | E400 | 0.6031 | 0.60 |

Panel E of Test I had a heavy manila paper face with a basis weight of 263.50 gm/m$^2$, a caliper of 17.22 mils, a density of 0.60 c/m$^3$ and a porosity of 58.97 seconds. This test sample illustrates that a face, although porous, but with too high an air flow resistivity is unsuitable for use with the invention. Panel BB of Test I indicates that a face with a higher air flow resistivity (see above table) than a painted scrim face can achieve a satisfactory NRC.

The acoustical panel of the invention can be manufactured in additional ways and with different constructions, but maintaining the perforations effectively restricted on at least the face (room) side of a completed panel. For example, where high NRC values are not needed, the rear layer 30 may be omitted. Porous paper may be substituted for either of the non-woven layers 29, 30.

Figure 3:
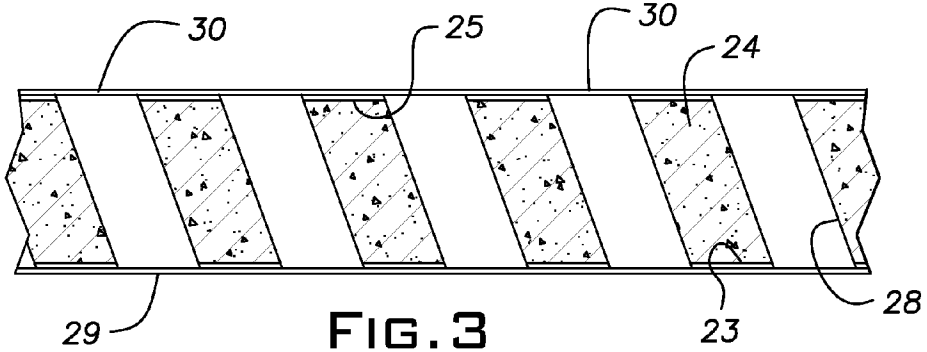
FIG. 3 is a fragmentary, enlarged, cross-sectional view of a modified form of an acoustical panel of the invention.

It has been further discovered that NRC can be measurably increased by orienting the perforations obliquely to the plane of the panel. Such a construction is illustrated in FIG. 3. The perforations 28 can, for example, be oriented at 20 degrees off a line perpendicular to the plane of the panel. The reason or reasons for this improved acoustical performance is not presently completely understood, but could be the result of a greater perforation volume and/or internal reflection of sound waves due to the oblique angle, and/or a greater effective open area at the face.

The foregoing disclosures involve modification of a conventional drywall sheet to convert it to the acoustical panel of the invention. However, the inventive acoustical panel can be originally manufactured with perforations in the gypsum core while it is being originally formed or immediately after it is formed and prior to attachment of one or both cover sheets or layers to its front face and rear side. The perforations, for example, can be cast into the gypsum body. The cross-section of the perforation in the various disclosed embodiments can be accircular when not drilled.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An acoustical panel for forming a ceiling or wall, the panel extending across a rectangular area with a nominal thickness of about at least ½ in., the panel having a core made primarily of gypsum, the core being essentially coextensive with the panel area such that it has two opposed sides each of an area substantially equal to the area of the panel, the core having a multitude of perforations extending generally between its sides, the perforations being distributed substantially uniformly across the full area of the core and being open at face and rear sides of the core, the face side of the core being covered by an effectively visually imperforate porous layer when painted, the perforations being restricted by a porous covering at a rear side of the core, the porous layer at the face side of the core being suitable for adherence by conventional drywall joint compound and a water-based non-blocking paint, the panel, after the porous layer at the face side of the core and joint compound are painted with said non-blocking paint, being adapted to exhibit an NRC of 0.50 or more.

2. An acoustical panel as set forth in claim 1, wherein long edges of the panel are slightly tapered for receiving joint tape and joint compound.

3. An acoustical panel as set forth in claim 1, having a nominal width of 4 feet and a nominal length of at least 8 feet.

4. An acoustical panel for forming a ceiling or wall, the panel extending across a rectangular area with a nominal thickness of about at least ½ in., the panel having a core made primarily of gypsum, the core being essentially coextensive with the panel area such that it has two opposed sides each of an area substantially equal to the area of the panel, the core having a multitude of perforations extending generally between its sides, the perforations being distributed substantially uniformly across the full area of the core and being open at face and rear sides of the core, the face side of the core being covered by a porous non-woven layer that is effectively visually imperforate when painted with a non-blocking paint, the perforations being restricted at a rear side of the core by a porous acoustical non-woven fabric, the porous non-woven layer at the face side of the core being suitable for adherence by conventional drywall joint compound and a water-based non-blocking paint, the panel, when installed and the porous non-woven layer covering the face side of the core is painted with a non-blocking paint capable of concealing said joint compound, being adapted to exhibit a NRC of 0.50 or greater.

5. An acoustical panel as set forth in claim 1, wherein the rear side of the panel includes a porous paper layer effective to restrict the core perforations.

6. An acoustical panel as set forth in claim 1, wherein face and rear sides of the core are covered with respective paper layers having perforations in registry with the core perforations.

7. An acoustical monolithic ceiling or wall construction comprising a generally planar grid of spaced parallel support elements, a plurality of acoustical panels secured at their rear sides to the support elements in a manner such that the panels each bridge spaces between the support elements, the panels forming joints between adjacent panels, the joints overlying respective support elements, each panel having a gypsum core forming a major part of a thickness of a panel, the core having a multitude of spaced perforations distributed across substantially a full area of the core, the core perforations being open or only partially restricted at a rear side of the panel, a porous layer covering the perforations on a face side of the core, the joints between panels at their faces being concealed by tape and joint compound on the porous layer and by a continuous non-blocking coating of paint over the full faces of the panels including the tape and joint compound at their joints while an acoustically effective porosity of the porous layer is maintained whereby the construction exhibits a NRC of at least 0.50.

8. An acoustical construction as set forth in claim 7, wherein a collective cross-sectional area of the perforations of a panel is about 20% of a total area of the face of the panel.

9. An acoustical construction as set forth in claim 7, wherein a collective cross-sectional area of the perforations of a panel is between about 9% and about 28% of a total area of the face of the panel.

10. An acoustical construction as set forth in claim 7, wherein a panel is formed by perforating a sheet of conventional drywall.

11. An acoustical construction as set forth in claim 10, wherein the drywall is through perforated.

12. An acoustical construction as set forth in claim 7, including an acoustical non-woven porous fabric laminated to a rear side of each panel.

13. An acoustical monolithic ceiling or wall construction comprising a generally planar grid of spaced parallel support elements, a plurality of acoustical panels secured at their backsides to the support elements in a manner such that the panels each bridge spaces between the support elements, the panels forming joints between adjacent panels, the joints overlying respective support elements, each panel having a gypsum core forming a major part of a thickness of a panel, the core having a multitude of spaced perforations distributed across substantially a full area of the core, a porous non-woven layer covering the perforations on a face side of the core, an acoustical non-woven porous fabric laminated to a rear side of each panel to form the panel backside, the joints between adjacent panels at their faces being concealed by a continuous non-blocking coating of paint formed in situ over the full faces of the panels including their joints, the non-blocking paint leaving sufficient porosity in the porous non-woven layer at the face side of the core for the construction to achieve a NRC of at least 0.50.

* * * * *